United States Patent [19]

Michowski

[11] 3,986,219

[45] Oct. 19, 1976

[54] COLLAPSIBLE CATAMARAN

[75] Inventor: Joseph Michowski, Bergenfield, N.J.

[73] Assignee: Lawrence Peska Associates, Inc., New York, N.Y. ; a part interest

[22] Filed: Feb. 12, 1975

[21] Appl. No.: 549,322

[52] U.S. Cl. ..... 9/2 C; 9/2 S; 114/61

[51] Int. Cl.[2] ..... B63B 7/04

[58] Field of Search ..... 9/2 R, 2 S, 2 C, 2 F; 114/61, 39, 66.5 F, 77 R

[56] References Cited

UNITED STATES PATENTS

| | | | |
|---|---|---|---|
| 2,053,755 | 9/1936 | Wilcox | 9/2 C |
| 2,401,453 | 6/1946 | Bell et al. | 9/2 S |
| 2,415,495 | 2/1947 | Humphreys | 9/2 S |
| 3,045,263 | 7/1962 | Blachly | 114/66.5 F |
| 3,613,136 | 10/1971 | Cogliano | 9/2 S |
| 3,877,406 | 4/1975 | Davis | 114/39 |

FOREIGN PATENTS OR APPLICATIONS

| | | | |
|---|---|---|---|
| 60,707 | 1/1955 | France | 114/61 |
| 1,150,577 | 1/1958 | France | 114/61 |

OTHER PUBLICATIONS

Dayton Marine Products, "Catyak", 1972 and Photograph.

*Primary Examiner*—Trygve M. Blix
*Assistant Examiner*—Charles E. Frankfort

[57] ABSTRACT

A collapsible catamaran can be easily disassembled into its component aluminum parts for storage and transportation. The collapsible catamaran consists of a pair of two sectional portions, wherein each section of each portion has an upward extending tubular member attached thereon. A rectangular shaped frame has parallel sides and parallel ends, wherein the sides and ends are detachably joined together by union elbow coupling members, wherein the coupling members detachably fit onto the coupling member.

3 Claims, 4 Drawing Figures

COLLAPSIBLE CATAMARAN

SUMMARY OF THE INVENTION

My invention relates to a unique and novel collapsible catamaran that can be easily disassemblied into its component aluminum parts for easy transportation and storage.

A number of U.S. Pat. Nos.: 2,917,754; 3,608,112; and 3,613,136 have employed collapsible boats, but these aforementioned patents are non-applicable to my present invention.

An object of my present invention is to provide a collapsible catamaran capable of being easily disassemblied into its light-weight component aluminum parts.

A further object of my present invention is to provide pontoons wherein each pontoon is formed from two interlocking sections.

A still further object of my present invention is to provide a collapsible catamaran of simple design and relatively low manufacturing cost.

Briefly, my present invention comprises a pair of two sectional portions, wherein each section of each portion has an upward extending tubular member attached thereon. A rectangular shaped frame has parallel sides and parallel ends, wherein the sides and ends are detachably joined together by union elbow coupling members, wherein the coupling members detachably fit onto the tubular member.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
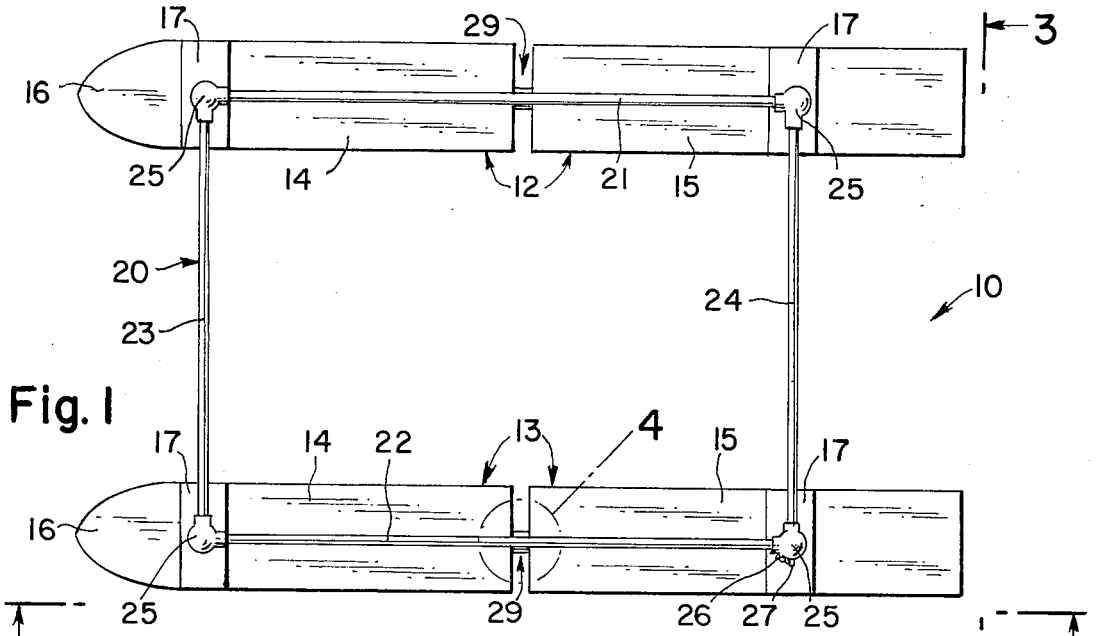
FIG. 1 illustrates a top view of a collapsible catamaran.
Figure 2:
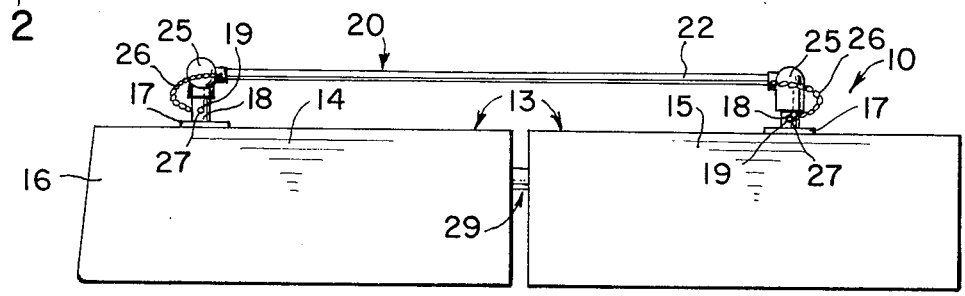
FIG. 2 illustrates a side view of the collapsible catamaran taken along lines 2—2 of FIG. 1.
Figure 3:
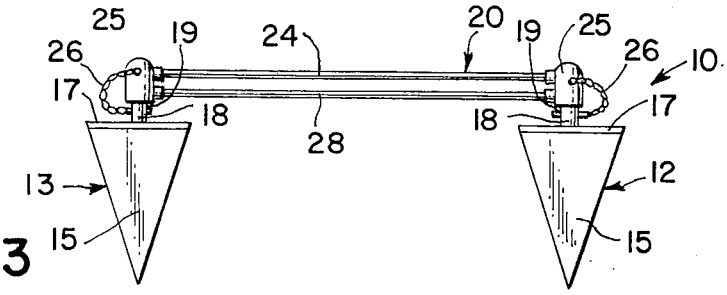
FIG. 3 illustrates an end view of the collapsible catamaran taken along lines 3—3 of FIG. 1.

Turning now descriptively to the drawings, in which similar reference characters denote similar elements throughout the several views, FIGS. 1–3 show a collapsible catamaran 10 easily disassemblied into its component aluminum parts for storage and transportation. The catamaran 10 comprises a pair of parallel pontoons 12, 13, wherein each pontoon 12, 13 has a forward 14 and a rearward 15 section. Each section 14, 15 is of a generally triangular cross section, wherein the forward end 16 of the forward section 14 is tapered. A rectangular shaped plate member 17 is affixed onto the top surface of each section 14, 15 of each pontoon 12, 13. An upward extending tubular member 18 is affixed onto each plate member 17, wherein each member has a transverse hole 19 therethrough. A rectangular shaped frame 20 consists of a pair of parallel sides 21, 22 and a pair of parallel ends 23, 24, with the sides 21, 22 and ends 23, 24 are detachably joined together at each corner by a union elbow coupling member 25.

Each union elbow coupling member 25 detachably fits onto the top end of each tubular member 18 so as to join the pontoons 12, 13 to the frame 20. A chain member 26 is joined onto each coupling member 25, wherein a pin element 27 is affixed onto the free end of each chain member 26. Each pin element 27 inserts into each transverse hole 19 of each tubular member 18. A reinforcing tube member 28 is contained below the rear end 24 of the frame 20, wherein tube members 28 communicate between the two rear coupling members 25.

Figure 4:
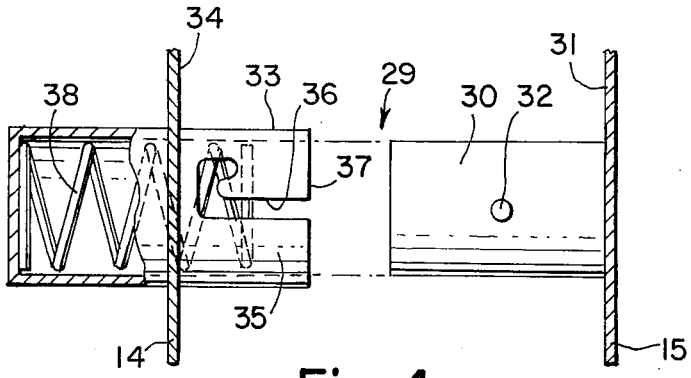
FIG. 4 illustrates a side cross sectional view of the locking mechanism joining the two sections of each pontoon.

FIG. 4 shows a locking mechanism 29 joining the forward section 14 to the rearward section 15 of each pontoon 12, 13. The locking mechanism 29 consists of a cylindrical rod 30 affixed centrally onto a forward face 31 of the rearward section 15, wherein a pin member 32 extends perpendicular outward from the sidewall of the rod 30. A sleeve member 33 is embedded into the rear end 34 of the forward section 14, wherein the sleeve member 33 extends rearwardly outward from the rear end 34. The exposed portion of the sidewall 35 of sleeve member 33 has a J-shaped slot 36 therein, wherein the stem of the J-shaped slot 36 extends inward from the free outer end 37 of sleeve member 33. A tension spring member 38 is contained within sleeve member 33. Rod 30 inserts into sleeve member 33, wherein pin member 32 slides within slot 36. As rod 30 is twisted within sleeve member 33, pin member 32 locks within the base portion of slot 36 and tension spring member 38 engages rod 30 within sleeve member 33.

Hence, obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. A collapsible catamaran, which comprises:

a. a rectangular shaped frame having a pair of parallel sides and a pair of parallel ends;

b. four union elbow coupling members joining said sides and said ends together;

c. a pair of parallel pontoons, each said pontoon having a forward section with a forward tapered end and a rearward section;

d. a locking means for joining said forward section to said rearward section of each said pontoon, each said locking means including a cylindrically shaped rod affixed centrally onto a forward face of said rearward section, a pin member affixed perpendicularly onto a sidewall of said cylindrically shaped rod, a sleeve member partly embedded into a rear end of said forward section, a tension spring contained in said sleeve member, a sidewall of an exposed portion of said sleeve member having a J-shaped slot therein, said cylindrically shaped rod inserting into said sleeve member, said pin member slidably contained and locking in said J-shaped slot, and said tension spring engaging said rod within said sleeve member;

e. a pair of tubular members extending upwardly from each said pontoon, each said tubular member having a transverse hole therethrough, each said tubular member communicating with one of said coupling members; and f. a plurality of chain members having end pin elements attached to one end thereof, each said chain member having its other end fixed to a coupling member, each said pin element being insertable into one of said transverse holes in a respective tubular member, when said tubular member is inserted into said coupling member to join the frame and pontoons together.

2. A collapsible catamaran as recited in claim 1, wherein each said pontoon has a triangular cross section.

3. A collapsible catamaran as recited in claim 1, wherein said frame and said pontoons are formed from aluminum.

* * * * *